US005409106A

United States Patent [19]

Okuda

[11] Patent Number: 5,409,106

[45] Date of Patent: Apr. 25, 1995

[54] COIN HOLDING TOOL

[76] Inventor: Norimichi Okuda, 2-12, Sakae-Machi, Seidaiji, Nara City, Nara-Ken, Japan

[21] Appl. No.: 289,311

[22] Filed: Aug. 11, 1994

[30] Foreign Application Priority Data

Feb. 22, 1994 [JP] Japan ..... 6-962

[51] Int. Cl.[6] ..... A45C 1/00

[52] U.S. Cl. ..... 206/0.8; 206/0.81; 206/45.34

[58] Field of Search ..... 206/0.8, 0.81, 0.83, 206/0.84, 5, 44 R, 45.14, 45.31, 45.33, 45.34

[56] References Cited

U.S. PATENT DOCUMENTS

| | | | |
|---|---|---|---|
| 1,719,962 | 7/1929 | Beistle | 206/0.8 |
| 1,833,037 | 11/1931 | Poeter | 206/0.81 |
| 2,556,806 | 6/1951 | Gaire . | |
| 2,998,126 | 8/1961 | Jenkins . | |
| 3,333,680 | 8/1967 | Segel | 206/0.83 |
| 3,554,625 | 9/1968 | Sly, Sr. . | |
| 3,837,475 | 9/1974 | Bolanz | 206/0.8 |
| 3,957,157 | 5/1976 | Therrien . | |
| 3,964,829 | 7/1976 | Munis . | |
| 4,043,477 | 8/1977 | Deese | 206/0.83 X |
| 4,309,111 | 1/1982 | Sobresky, Sr. . | |
| 4,592,465 | 6/1986 | Stein . | |
| 5,353,924 | 10/1994 | Jaffee | 206/0.84 X |

*Primary Examiner*—Jacob K. Ackun
*Attorney, Agent, or Firm*—Peter Jon Gluck; Morrison Law Firm; Thomas R. Morrison

[57] ABSTRACT

A coin holding tool includes a rectangular frame with a slidable magnifier-loading platform, orthogonally disposed to and attachedly mounted thereon. The coin holding tool enables one to identify, arrange and preserve collected coins. Additionally, the means for loading a magnifier permits one to compare rare coins and distinguish and appreciate subtle differences in their respective appearances. A stand is also taught which enables the frame to be propped at an oblique angle.

13 Claims, 5 Drawing Sheets

COIN HOLDING TOOL

BACKGROUND OF THE INVENTION

The present invention relates to coin holders used in the collection, preservation and appreciation of rare or defective coins, the coins being mounted such that either one or both sides may be viewed. In particular, the present invention relates to a durable coin holding tool which allows for the arrangement and preservation of collected coins, with a slidabley attached magnifying lense to enable a viewer to distinguish subtle differences among individually housed coins.

Four general types of coin holders known in pertinent art. Among these are single coin holders made from folded cardboard-type material having transparent sides, with coins disposed therebetween. Difficulty loading and unloading these coin holders distinguishes them from the present invention.

Also known are flat, capped containers which can be opened or closed freely. Such conventional coin holders are made from hard synthetic resins, and include cushioning materials disposed at their bottoms for receiving coins. U.S. Pat. No. 3,957,157 discloses this type of coin holder, having the drawback that when coins are put into or removed from it, the coins may be touched by a user's fingers, leaving finger prints on the surfaces of the coins. The present invention addresses and overcomes this problem of the prior art.

U.S. Pat. No. 2,998,126 and U.S. Pat. No. 4,592,465 disclose coin holders for commemorative coins having inner based boards with holes having diameters related directly to the diameters of the displayed coins and transparent covers. In these patents, first and second transparent sides are attached to at least one plastic (polyethylene or cellophane) base board to form a sandwiched structure which is then permanently fixed at the corners.

The present invention differs from these two holders for commemorative coins. Conventional coin holders such as these are designed to collect and preserve only coins having fixed sizes. These coin holders for commemorative coins cannot be used to collect and preserve coins having sizes which differ from the sizing of the holes in the inner base boards.

The fourth general type of coin holder combines a plurality of the single coin holders mentioned above into album form, with one of various types of holding frames. U.S. Pat. No. 3,554,625 discloses such a display device, having at least four holding frames for housing a plurality of single coin holders. Numerous problems exist with these conventional coin holders which are addressed and solved by the present invention.

Durability is a longstanding problem among conventional coin holders. For example, when the aforementioned single coin holders are made (for example) from transparent pockets consisting essentially of synthetic resins, the pockets often yield to minor mechanical stresses and break after sustained periods of usage. Further, during periods of increased barometric pressure, heat and humidity the materials of the pockets often soften. This causes the openings of the pockets to stick, and increases the difficulty of putting in and removing coins.

In cases where single coin holders are placed in holding frames, the holding frames may break and become useless after extended usage. Furthermore, in order to distinguish the subtle, valuable portions of the ancient or defective coins using known coin holders, it is necessary to use a separately prepared magnifier while viewing the displayed coins.

OBJECTS AND SUMMARY OF THE INVENTION

Accordingly, it is an object of the invention to overcome the drawbacks of the prior art.

It is another object of the present invention to provide a coin holding tool to arrange and preserve collected coins.

It is a further object of the present invention to provide a slidabley attached magnifying lense to enable a user to selectively view either one or both sides of the housed coins.

It is still a further object of the present invention to provide a coin holder with endurance.

It is yet another object of the present invention to provide a coin holding tool to enable a user to clearly distinguish the subtle differences among coins and easily appreciate respective values of the coins based upon individualized features inherent in their appearences.

It is still a further object of the present invention to provide a coin holder which allows coins having large sizes to be placed into holes pre-drilled in a coin-placing plate, while allowing other coins having various sizes to be placed into spacers and placed into the holes with the spacers.

Again, it is still a further object of the present invention to provide a coin holding tool device which allows more than one coin holder to be housed within a frame.

Briefly stated, there is provided a coin holding tool which comprises a rectangular frame with a slidable magnifier-loading platform attachedly mounted thereon. The coin holding tool enables one to identify, arrange and preserve collected coins. Additionally, the means for loading a magnifier permits one to compare rare coins and distinguish and appreciate subtle differences in their respective appearances. A stand is also taught which enables the frame to be propped at an oblique angle.

According to an embodiment of the invention, there is provided a coin holding tool device, comprising a frame, having a generally rectangular body including first, vertical, and second, horizontal, opposed sides, a coin placing plate having a plurality of circular holes for retaining coins and the like, which coin placing plate is overlapped by at least one transparent plate on at least one side, and means fox-loading a magnifier, wherein the means is slidably mounted on one of said first and second opposed sides.

According to a further embodiment of the invention there is provided a coin holding toot device, comprising, a frame, having a generally rectangular body, including first and second opposed sides, a coin placing plate having a plurality of circular holes for retaining coins and the like, which coin placing plate is overlapped by at least one transparent plate on at least one side, a magnifier loading platform having a slot with a step disposed horizontally upon one of the first and second opposed sides, a slidable, magnifier supporting member disposed in said slot with a step, and a magnifier disposed on said magnifier supporting member.

According to a still further embodiment of the invention there is provided a coin holding tool device, comprising, a frame, having a generally rectangular body including first and second opposed sides, a coin placing plate having a plurality of circular holes for retaining coins and the like, which coin placing plate is overlapped by at least one transparent plate on at least one side, a magnifier loading platform having a slot with a step disposed horizontally upon one of the first and second opposed sides, a slidable, magnifier supporting member disposed in the slot with a step, a magnifier disposed on the magnifier supporting member, a spacer is placed between the circular hole and an outer circumference of each coin, the frame is filled up by a plurality of square, coin placing plates, which coin placing plates are in a shape of square or rectangle, and each of the coin placing plates are overlapped by transparent plates on at least one side, wherein said frame further comprises, a blind hole disposed at corners of the both sides of said frame and a cushion member inserted in the blind hole at corners of one side of the frame, the frame further comprising, a concave groove disposed at outer surface of a side rim of said frame, an angled standing member, and an open end of said standing member inserted in said concave groove.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENTS

Figure 1:
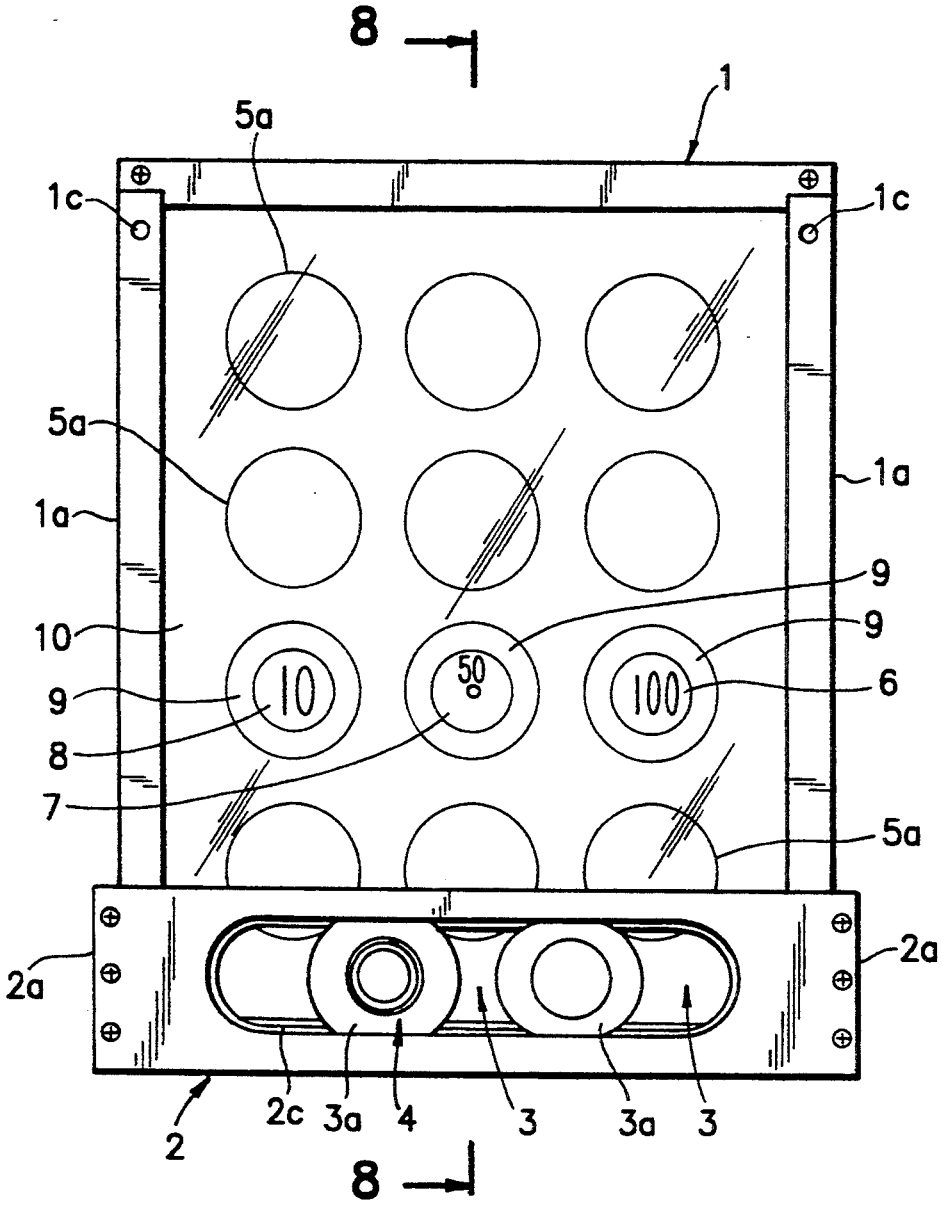
FIG. 1 is a front view of a coin holder according to an embodiment of the present invention.

Referring now to FIG. 1, a frame 1 is generally rectangular and made of aluminum by die casting, or is made of wood. A concave groove 1*b* (not shown) is disposed on the outside surface of each of the opposed long, vertical side rims 1*a* of frame 1.

A holding member 2*a*, orthogonally disposed on frame 1, is disposed at both ends of a long narrow board, forming a magnifier loading platform 2. On the opposing side of each holding member 2*a*, a convex rail portion extends from side rim 1*a* (not shown) and protrudes from magnifier loading platform 2. A convex rail portion of side rim 1*a* engages with concave groove 1*b* on each side rim 1*a* of the frame 1. Convex rail portion of side rim 1*a* slides freely inside concave groove 1*b*.

On magnifier loading platform 2, a slot with step 2*c* is disposed horizontally upon the board. With convex rail portions of each side rim 1*a*, sliding freely inside each of the concave grooves 1*b*, magnifier loading platform 2 slides freely on frame 1.

A slidable flange edge 3*a*, which is inserted in slot with step 2*c* of magnifier loading platform 2, protrudes as a short cylinder from slot with step 2*c*. A magnifier supporting member 3 houses a magnifier 4, within the slot with step 2*c*.

Coin placing plate 5, contains spacers 9 and variously sized coin receiving holes 5*a*, illustrated retaining a plurality of differentially sized coins 6, 7, and 8. Note that the coins, 6, 7, and 8 may have diameters which vary and are adjustable through the use of differently sized spacers 9.

Transparent plate 10 covers coin placing plate 5 on at least one of a first and second side. Variously sized coin receiving holes 5*a*, may be arranged as shown in the figure, or in any number of related configurations. No further explanation is required since such related configurations are known in the art.

Figure 2:
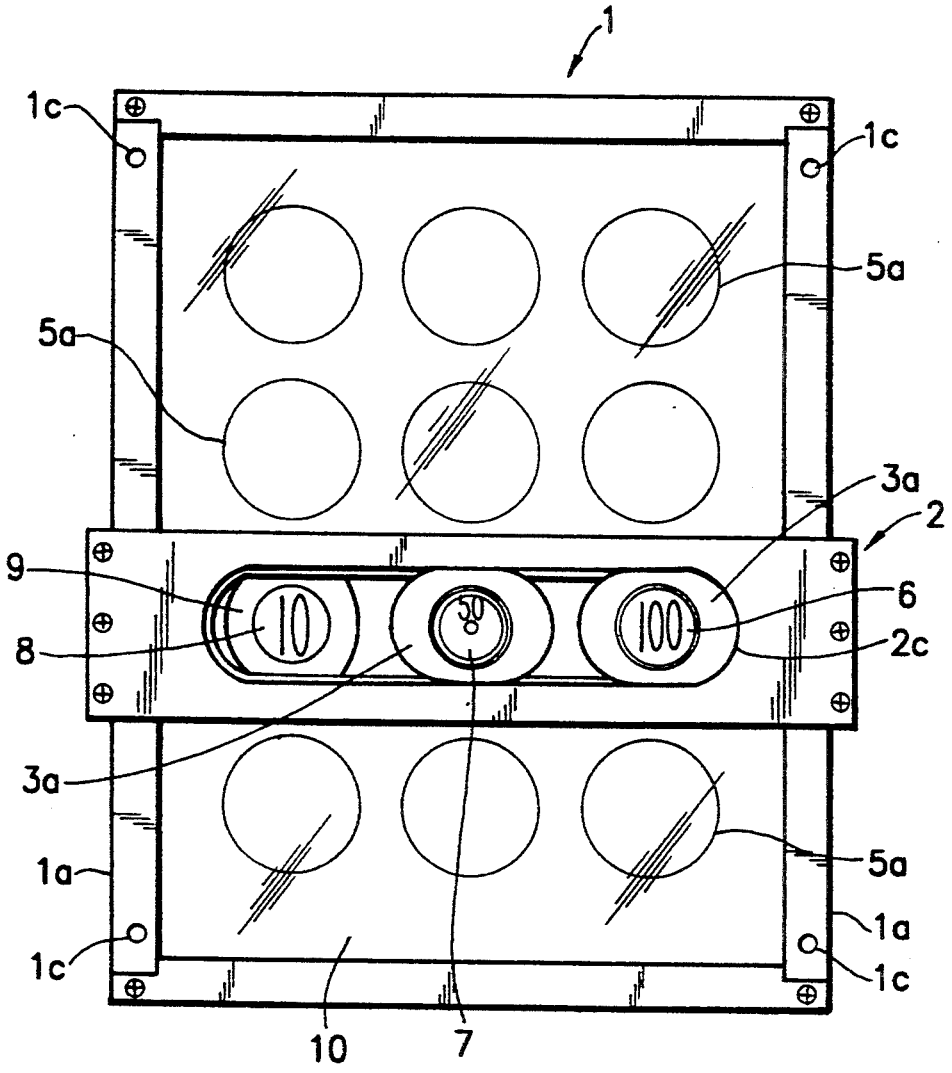
FIG. 2 is a front view of a coin holder according to an embodiment of the present invention, showing movement of the magnifier loading platform from a first to a second position.

Referring now to FIG. 2, a frame 1 is generally rectangular and made of aluminum by die casting, or is made of wood. A concave groove 1*b* (not shown) is disposed on the outside surface of a long, vertical side rim 1*a* of frame 1.

A holding member 2*a* is disposed at a midpoint of vertical side rim 1*a* of frame 1, holding magnifier loading platform 2. In this view, magnifier loading platform 2 is shown in a second position for selectively viewing a plurality of differentially sized coins 6, 7, and 8.

A slidable flange edge 3*a*, which is inserted in slot with step 2*c* of magnifier loading platform 2, protrudes as a short cylinder from slot with step 2*c*. A magnifier supporting member 3 houses a magnifier 4, within the slot with step 2*c*.

Figure 3:
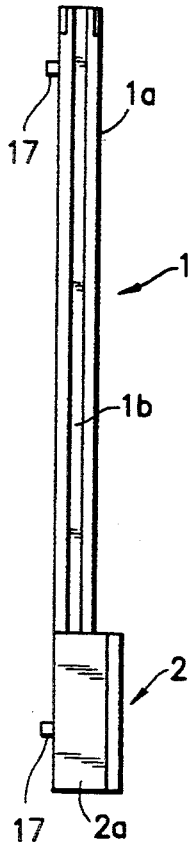
FIG. 3 is a side view of a coin holder according to an embodiment of the present invention.

Referring now to FIG. 3, holding member 2*a* is shown disposed at a first end of vertical side rim 1*a* of frame 1, holding a magnifier loading platform 2. A blind hole 1*c* (not shown) is formed at the four corners of the aforementioned frame 1. A cushion member 17 made from rubber is inserted in blind holes 1*c* (not shown) at the four corners of one side of frame 1.

Figure 4:
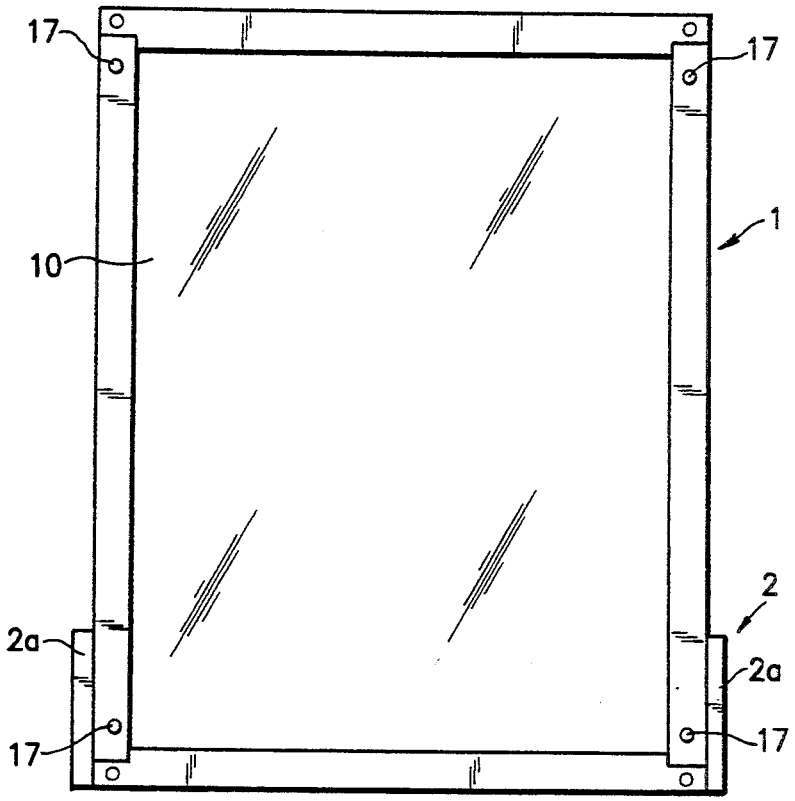
FIG. 4 is a cross-section of a rear view of a coin holder according to an embodiment of the present invention.

Referring now to FIG. 4, transparent plate 10 covers coin placing plate 5 (not shown) on at least one of a first and second side. Holding member 2*a* is shown disposed at a first end of vertical side rim 1*a* of frame 1, holding a magnifier loading platform 2. A blind hole 1*c* (not shown) is formed at the four corners of the aforementioned frame 1. A cushion member 17 made from rubber is inserted in blind holes 1*c* (not shown) at the four corners of one side of frame 1.

Figure 5:
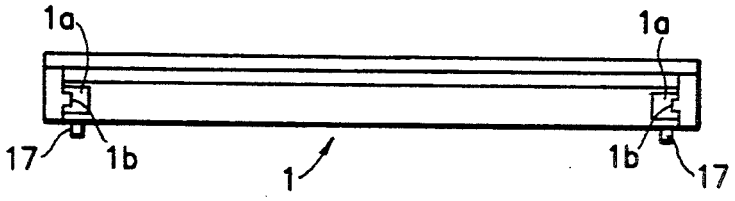
FIG. 5 is a bottom view of a coin holder according to an embodiment of the present invention.

Referring now to FIG. 5, a concave groove 1*b* is disposed on the outside surface of each of the long, vertical side rims 1*a* of frame 1. A blind hole 1*c* (not shown) is formed at the four corners of the aforementioned frame 1. A cushion member 17 made from rubber is inserted in blind holes 1*c* (not shown) at the four corners of one side of frame 1.

Figure 6:
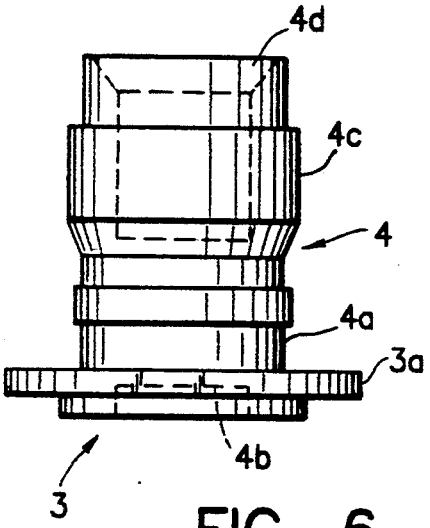
FIG. 6 is a cross-section of front view of a magnifier supporting member in a coin holder according to the present invention which shows a magnifier loading platform in a vertical position.
Figure 7:
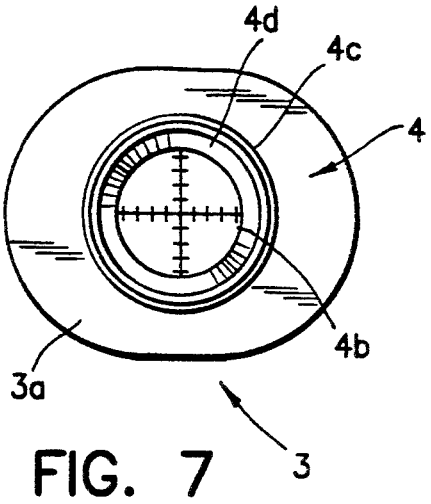
FIG. 7 is a top view of a magnifier supporting member in a coin holder according to the present invention which shows a magnifier loading platform in a vertical position.

Referring now to FIG. 6 and FIG. 7, a slidable flange edge 3*a*, which is inserted in slot with step 2*c* (not shown) of magnifier loading platform 2 (not shown) protrudes as a short cylinder from slot with step 2*c*. A magnifier supporting member 3 houses a magnifier 4, within the slot with step 2*c*.

A light-admitting portion 4*a* of a magnifier 4 is lightly inserted in magnifier supporting member 3. A scale display 4*b* is inserted in the short cylinder. Magnifier 4 slides on magnifier loading platform 2. Magnifier 4 is attached by a focus-distance adjusting ring 4*c* and an eyepiece 4*d*.

Figure 8:
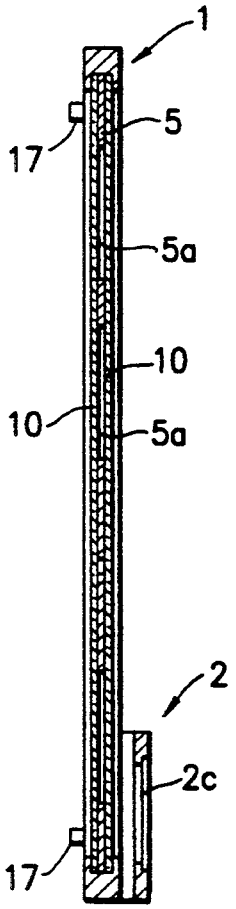
FIG. 8 is a cross sectional view a side view of a coin holder according to an embodiment of the present invention as shown in FIG. 1.

Referring now to FIG. 8, holding member 2*a* is shown disposed at a first end of vertical side rim 1*a* of frame 1, holding a magnifier loading platform 2. Transparent plates 10 covers coin placing plate 5 on at least one of a first and second side. Variously sized coin receiving holes 5*a*, may be arranged as shown in the figure, or in any number of related configurations.

A blind hole 1*c* (not shown) is formed at the four corners of the aforementioned frame 1. A cushion member 17 made from rubber is inserted in blind holes 1*c* (not shown) at the four corners of one side of frame 1.

A coin placing plate 5 is formed from a material (for example "HAPPOT" made by PARONIYA PP of Japan, which is a trade name) which generates low levels of static electricity. Coin placing plate 5 is cut to form a plurality of circular holes 5*a*. The maximum diameter of a circular hole 5*a* is related to the diameter of a coin which has the maximum diameter (for example 43 ram). For coins having diameters smaller than the maximum diameter, a spacer 9 is placed in circular hole 5*a* to fill up the gap between each coin and circular hole 5*a*.

Figure 9:
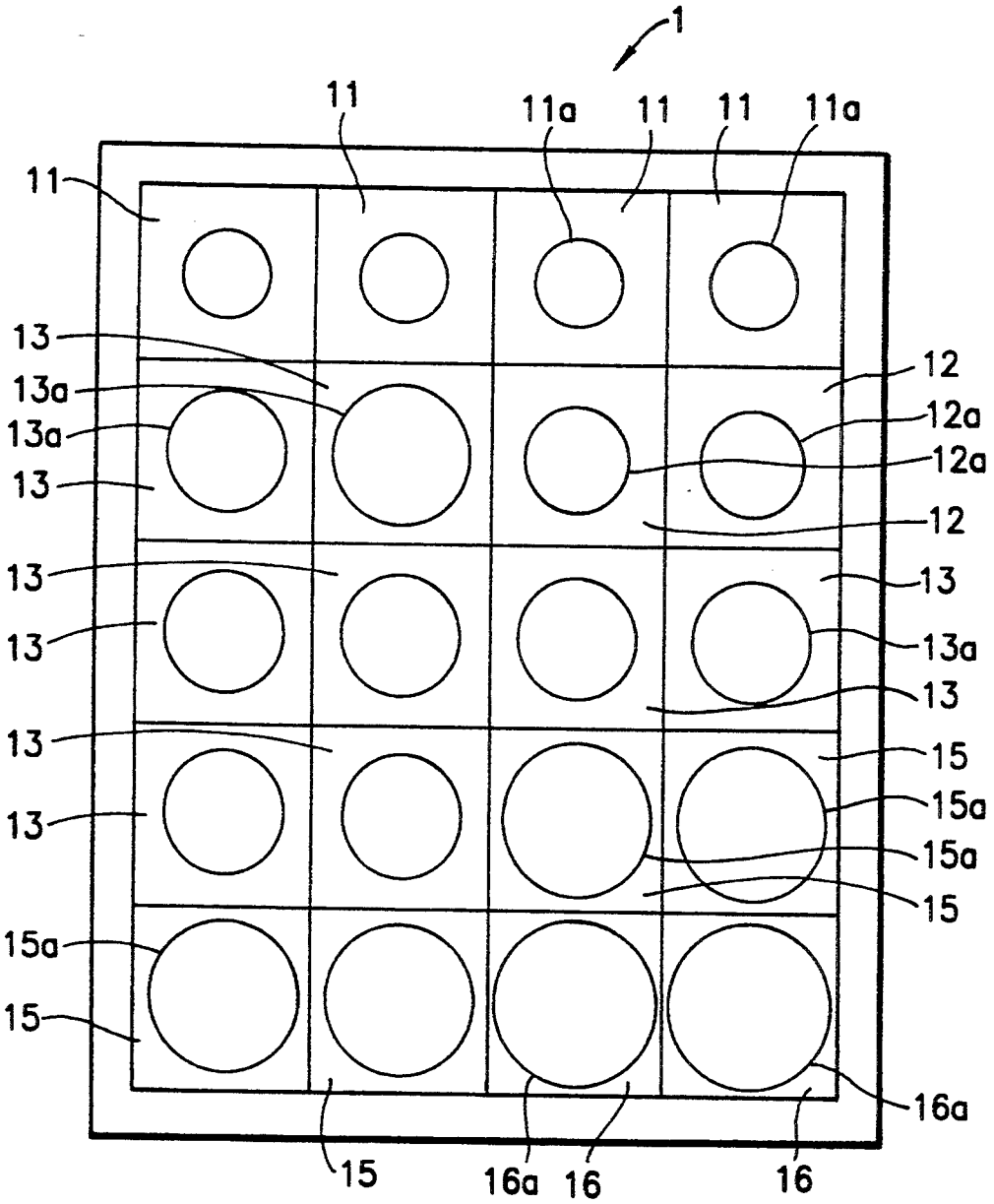
FIG. 9 is a front view of a coin holder according to the present invention, showing a group of coin holders placed inside the frame.

Referring now to FIG. 9, the two sides of coin placing plate 5 are overlapped by a transparent plate 10 which is made from an acrylic material. The three-layer structure thus formed is inserted inside frame 1. It is preferred that the material of spacer 9 is softer than that of coins. Coin placing plate 5 is cut to form a plurality of circular holes 5*a*. An alternate preferred embodiment is shown in FIG. 9 using square plates.

In the middle portions of each square plate, circular holes 11*a*, 12*a*, 13*a*, 14*a*, 15*a*, and 16*a* are cut with diameters complimentary to that of each coin, forming coin holders 11, 12, 13, 14, 15, and 16. The two sides of each coin holder are covered by tile aforementioned transparent plate 10. These coin holders fill up the space of frame 1 without leaving any gap in the frame.

Figure 10:
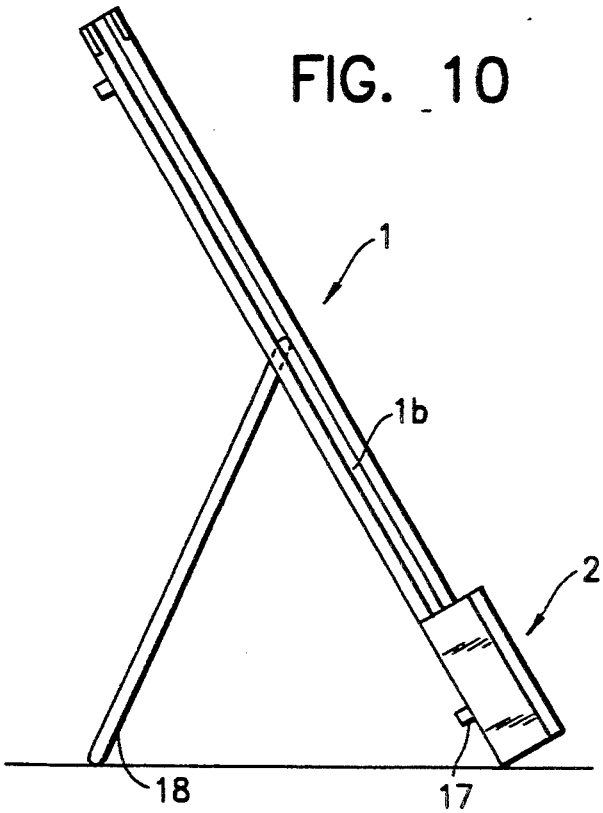
FIG. 10 is a side view of a coin holder equipped with a standing member at the frame according to the present invention, where the standing member stands obliquely.

Referring now to FIG. 10, a blind hole 1*c* (not shown) is formed at the four corners of the aforementioned frame 1. A cushion member 17 made from rubber is inserted in blind holes 1*c* at the four corners of one side of frame 1. As shown in FIG. 10, a first end of angled standing member 18 is inserted in concave groove 1*b* of frame 1, so that frame 1 stands obliquely.

The advantages and effectiveness of this invention are dear. Owing to tile materials used in frame 1 (at leat one of aluminum and wood) the endurance is superior. As there is no direct contact with the coins, there are no issues related to the potential damage caused by dropping coins. If desired, valuable portions of the coins can be further examined by moving magnifier 4 on both the front and rear sides of the coin and adjusting the focus-distance. With spacer 9, a number of different kinds of coins can be stored in one frame. As stand 18 is attached to concave groove 1*b* of frame 1, the coin holder can stand on top of a desk, and used as a decoration. Additionally, at number of frames can be piled up and stored in a compact and neat fashion because the rubber-made cushion members 17, at the four corners of frame 1 are inserted in blind holes 1 of another frame.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A coin holding tool device, comprising:

a frame, having a generally rectangular body including first and second opposed sides;

a coin placing plate having a plurality of circular holes for retaining coins and the like;

said coin placing plate being overlapped by at least one transparent plate on at least one side; and means for loading a magnifier, wherein said means is slidably mounted on one of said first and second opposed sides.

means for magnifying said plurality of circular holes.

2. The device according to claim 1, wherein said means for loading comprises:

a magnifier loading platform having a slot with a step disposed horizontally upon one of said first and second opposed sides; and a slidable, magnifier supporting member disposed in said slot with a step.

3. The device according to claim 1, wherein said means for loading comprises:

a magnifier disposed on said magnifier supporting member.

4. The device according to claim 3, wherein:

a spacer is placed between said circular hole and an outer circumference of said coin.

5. The device according to claim 4, wherein said frame is filled up by a plurality of square, coin placing plates;

said coin placing plates are in a shape of square or rectangle; and said coin placing plates are overlapped by transparent plates on at least one side.

6. The device according to claim 5, wherein said frame further comprises:

a blind hole disposed at corners of the both sides of said frame; and a cushion member inserted in said blind hole at corners of one side of said frame.

7. A device according to claim 6, wherein said frame further comprises:

a concave groove disposed at outer surface of a side rim of said frame;

an angled standing member having first and second ends, for fittingly engaging said concave groove; and a first end of said standing member being inserted in said concave groove.

8. A coin holding toot device, comprising:

a frame, having a generally rectangular body including first and second opposed sides;

a coin placing plate having a plurality of circular holes for retaining coins and the like;

said coin placing plate being overlapped by at least one transparent plate on at least one side;

a magnifier loading platform having a slot with a step disposed horizontally upon one of said first and second opposed sides;

a slidable, magnifier supporting member disposed in said slot with a step;

a magnifier disposed on said magnifier supporting member.

9. The device according to claim 8, wherein:

a spacer is placed between said circular hole and an outer circumference of said coin.

10. The device according to claim 9, wherein said frame is filled up by a plurality of square, coin placing plates;

said coin placing plates are in a shape of square or rectangle; and said coin placing plates are overlapped by transparent plates on at least one side.

11. The device according to claim 10, wherein said frame further comprises:

a blind hole disposed at corners of tile both sides of said frame; and a cushion member inserted in said blind hole at corners of one side of said frame.

12. The device according to claim 11, wherein said frame further comprises:

a concave groove disposed at outer surface of a side rim of said frame;

an angled standing member having first and second ends, for fittingly engaging said concave groove; and a first end of said standing member being inserted in said concave groove.

13. A coin holding tool device, comprising:

a frame, having a generally rectangular body including first and second opposed sides;

a coin placing plate having a plurality of circular holes for retaining coins and the like;

said coin placing plate being overlapped by at least one transparent plate on at least one side;

a magnifier loading platform having a slot with a step disposed orthogonally upon said first and second opposed sides;

a slidable, magnifier supporting member disposed in said slot with a step;

a magnifier disposed on said magnifier supporting member;

a spacer is placed between said circular hole and an outer circumference of said coin:

said frame is filled up by a plurality of square, coin placing plates;

said coin placing plates are in a shape of square or rectangle; and said coin placing plates are overlapped by transparent plates on at least one side;

wherein said frame further comprises:

a blind hole disposed at corners of the both sides of said frame; and a cushion member inserted in said blind hole at corners of one side of said frame, said frame further comprising:

a concave groove disposed at outer surface of a side rim of said frame;

an angled standing member having first and second ends, for fittingly engaging said concave groove; and a first end of said standing member being inserted in said concave groove.

* * * * *